US007470448B2

(12) United States Patent
Janz et al.

(10) Patent No.: US 7,470,448 B2
(45) Date of Patent: Dec. 30, 2008

(54) SYSTEM AND METHOD FOR APPLYING GLUE TO A MOVING WEB

(75) Inventors: Dietmar Janz, Trittau (DE); Mathias Blau, Hamburg (DE); Andreas Herburg, Trittau (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/766,941

(22) Filed: Jan. 30, 2004

(65) Prior Publication Data

US 2004/0216662 A1 Nov. 4, 2004

(30) Foreign Application Priority Data

Jan. 31, 2003 (EP) ..... 03090027

(51) Int. Cl.
*B05D 5/10* (2006.01)
*B05D 3/10* (2006.01)

(52) U.S. Cl. ..... 427/207.1; 427/335

(58) Field of Classification Search ..... 118/410, 118/669, 64, 65, 302, 610, 679, 683–684; 427/288, 286, 335, 338–340, 377, 375, 207.1–208.8; 156/308.8, 308.6, 305, 320; 131/67–69
See application file for complete search history.

(56) References Cited

U.S. PATENT DOCUMENTS 3,518,964 A * 7/1970 Nagler ..... 118/65
3,595,204 A * 7/1971 McIntyre et al. ..... 118/674
3,929,291 A 12/1975 Ladisch
4,013,037 A * 3/1977 Warning, Sr. et al. ..... 118/685
4,476,165 A * 10/1984 McIntyre ..... 427/258
4,549,915 A * 10/1985 Ritschel et al. ..... 156/78
4,725,468 A * 2/1988 McIntyre ..... 428/40.1
4,998,993 A * 3/1991 Kenderi et al. ..... 239/295
5,350,452 A * 9/1994 Rempe et al. ..... 118/669
5,360,629 A * 11/1994 Milbourn et al. ..... 427/8
5,540,774 A * 7/1996 Smitherman ..... 118/315
5,989,622 A * 11/1999 Iwashita et al. ..... 472/58

(Continued)

FOREIGN PATENT DOCUMENTS

DE 69104078 4/1995

(Continued)

OTHER PUBLICATIONS

European Office Action ( in English) dated Jun. 21, 2005 and prepared in connection with European Application No. 03 09 0027.*

*Primary Examiner*—Brenda A Lamb
(74) *Attorney, Agent, or Firm*—Greenblum & Bernstein, P.L.C.

(57) ABSTRACT

System and method for applying glue to a moving web. The system includes a glue nozzle coupled to glue reservoir. The glue nozzle has an outlet opening arranged to apply glue to the moving web while the moving web moves along a direction. A device delivers a substance to a region of the outlet opening. The device delivers the substance behind the outlet opening relative to the direction. The method includes applying the glue onto the moving web while the moving web moves along a direction and feeding the substance behind the outlet opening relative to the direction. This Abstract is not intended to define the invention disclosed in the specification, nor intended to limit the scope of the invention in any way.

3 Claims, 2 Drawing Sheets

U.S. PATENT DOCUMENTS

| | | | | |
|---|---|---|---|---|
| 6,117,237 | A * | 9/2000 | Yapel et al. | 118/410 |
| 6,248,407 | B1 * | 6/2001 | Hess | 427/480 |
| 6,267,300 | B1 * | 7/2001 | Venema | 239/290 |
| 2002/0023655 | A1 | 2/2002 | Fietkau | |
| 2002/0092922 | A1 | 7/2002 | Steiger | |

FOREIGN PATENT DOCUMENTS

| | | |
|---|---|---|
| DE | 4447016 | 7/1996 |
| DE | 19835532 | 2/2000 |
| EP | 0286212 | 10/1988 |
| EP | 0497936 | 8/1992 |
| JP | 6-114318 | 4/1994 |
| WO | 89/04727 | 6/1989 |
| WO | 01/02101 | 1/2001 |

* cited by examiner

SYSTEM AND METHOD FOR APPLYING GLUE TO A MOVING WEB

CROSS-REFERENCE TO RELATED APPLICATIONS

The present application claims priority under 35 U.S.C. § 119 of European Patent Application No. 03 09 0027.8, filed on Jan. 31, 2003, the disclosure of which is expressly incorporated by reference herein in its entirety.

BACKGROUND OF THE INVENTION

1. Field of the Invention

The invention concerns a system for the application of glue to a moving web, in particular a strip-like cigarette paper web in a continuous cigarette-making machine. The moving web may also be folding box blanks and the invention may also be used in a cigarette-packing machine. The system includes a contact glue nozzle which is connected to a reservoir filled with glue. The glue may be delivered by a conveying arrangement from the reservoir to the contact glue nozzle and may be conveyed out of an outlet opening in the region of the latter and applied to the web moving past the contact glue nozzle.

The invention also concerns a method for the application of glue to a moving web, in particular a strip-like cigarette paper web in a continuous cigarette-making machine. The moving web may also be folding box blanks and the invention may be utilized in a cigarette-packing machine. In the method, the web may move optionally continuously or intermittently and may be conveyed past a contact glue nozzle and provided with glue by way of the contact glue nozzle.

2. Discussion of Background Information

In cigarette manufacture, single or multiple tobacco strings are wrapped in cigarette paper which, after the application of glue, is closed to form the final cigarette string. In the manufacture of cigarette packs, the folding box blanks are provided with glue at predefined points. For the application of glue, the strip-like cigarette paper or an exposed edge thereof, the folding box blanks or other webs are conveyed past a device for the application of glue or, to be more precise, a glue nozzle. Usually this contact glue nozzle abuts against the moving web, namely e.g. the cigarette paper, and applies the glue to the cigarette paper conveyed continuously past the contact glue nozzle.

In the application of glue to other moving webs, e.g., folding box blanks, the contact glue nozzle can also be arranged a short distance from the folding box blanks which are moving intermittently past the contact glue nozzle. In the application of glue to the cigarette paper, the folding box blanks or the like, however, lingering soiling of the contact glue nozzle occurs. In particular, so-called "glue runs" form behind the contact glue nozzle in the direction of transport of the moving web, and usually at an acute angle formed by an outer wall of the contact glue nozzle and the moving web. These glue runs, which slowly get bigger and additionally carry dust, break off without definition after some time and are entrained in the direction of transport of the cigarette paper upon the application of glue to the cigarette paper. In the process, the string frequently breaks, which in turn leads to stoppage of the machine. In the application of glue to folding box blanks, glue runs referred to as stalagmites and stalactites form from the excess glue, e.g., between the contact glue nozzle and the blanks, leading to blockage of the nozzle and interruption of the process.

SUMMARY OF THE INVENTION

The present invention provides for a device/system which is suitable for removing the excess glue or preventing the formation of glue runs. Furthermore, the invention provides for a method which removes the excess glue or prevents the formation of glue runs.

The system provides that in the region of the outlet opening of the contact glue nozzle, a delivery device is arranged for the delivery of a substance suitable for liquefying the glue. In this way, the substance can be delivered directly behind the contact glue nozzle in the direction of transport of the moving web. With this construction according to the invention, in a surprisingly simple and effective manner, it is possible to prevent the formation of excess glue, particularly in the form of the glue runs already mentioned. This is because immediately after formation or accumulation of the excess glue, the additionally delivered substance leads to liquefaction thereof or liquefies already hardened excess glue. Moreover, due to the fact that the glue can be liquefied or thinned behind the contact glue nozzle in the direction of transport of the moving web, the excess glue is immediately conducted out of the "danger zone". Using such a system, a hardening of glue on the contact glue nozzle and hence soiling thereof is effectively avoided in the contact region formed between contact glue nozzle and moving web. Such an system also means that the glue cannot solidify at all in this area.

Advantageously, the delivery device is constructed as a capillary device, e.g., a thin tube. The particularly thin design of the delivery device—in other words, the particularly small diameter of the tube—firstly ensures that only a minimum quantity of the substance which is absolutely necessary for liquefaction/thinning is brought into the region behind the contact glue nozzle. Secondly, the capillary device ensures that a column of the substance to be delivered is always held in the delivery device itself, even when delivery is interrupted, so that no air collects within the delivery device.

In a preferred embodiment of the invention, the delivery device forms part of a measuring unit which includes a pressure regulator, a storage device or container for holding the substance, a pipe system, a fine filter, a fine measuring valve, a directional control valve and a control unit. Due to the fact that the delivery device forms part of a measuring unit, individual adjustment and control of the quantity of substance needed, as well as of the moments suitable for delivery, can be effected in a particularly exact manner. In particular, the volumetric stream of substance can be particularly finely varied. Also, there is the possibility, depending on the application, of automatically enabling continuous or cyclic delivery of the substance.

Particularly advantageous is a modular design of the measuring unit. As a result, in a particularly simple manner, existing machines, e.g. continuous cigarette-making machines, cigarette packing machines or the like with a traditional device for applying glue can be converted, which lowers, on the one hand, the maintenance effort and, on the other hand, the costs.

Furthermore, the invention provides for a method wherein directly behind the contact glue nozzle in the direction of transport of the moving web is delivered a substance suitable for liquefaction of the glue. As a result, the excess glue cannot solidify and/or build up at all. Additionally, accumulating excess glue can be immediately "flushed away", as it were. As a result of the invention; the glue runs typically formed by the excess glue do not form or are immediately liquefied, so that the risk of breaking of the string and blockage of the nozzle is avoided.

Advantageously, the substance can be delivered cyclically. This has a number of advantages. Firstly, it is ensured that there is always sufficient substance to thin or liquefy the glue runs/excess glue and so prevent the formation of glue runs. Secondly, the supply of the substance is however limited to the necessary amount, so that the substance delivered can also be absorbed by the moving web, e.g. the cigarette paper.

The invention is also directed to a system for applying glue to a moving web. The system comprises a glue nozzle, coupled to glue reservoir, and including an outlet opening arranged to apply glue to the moving web while the moving web moves along a direction, and a device that delivers a substance to a region of the outlet opening. The device delivers the substance behind the outlet opening relative to the direction.

The moving web may comprise one of a cigarette paper web in strip form and folding box blanks. The system may be arranged on one of a continuous cigarette making machine and a cigarette packing machine. The substance may comprise at least one of a substance adapted to liquefy the glue, a low-viscosity fluid, water, and water vapor. The device may deliver the substance directly behind the outlet opening relative to the direction.

The device is adapted to deliver the substance in the form of spots. The device may comprise one of a capillary, a tube, and a hollow member. The glue nozzle and the device may be separately formed devices. The device may be arranged at a distance "d" from the glue nozzle. The device may be one of arranged directly adjacent to the glue nozzle and arranged to abut the glue nozzle. The glue nozzle and the device may comprise one of a one-piece member and an integrally formed member.

The system may further comprise a system for feeding the substance to the device. The system for feeding the substance may regulate an amount of the substance which is applied to the moving web. The system for feeding the substance may comprise a pressure regulator, a storage device for storing the substance, a system of pipes, a fine filter, a fine measuring valve, a directional control valve and a control unit. The system for feeding the substance may comprise a measuring unit having a modular construction.

The invention is also directed to a method of applying glue to a moving web utilizing a system that includes a glue nozzle, coupled to glue reservoir, and comprising an outlet opening arranged to apply glue to the moving web, and a device that delivers a substance to a region of the outlet opening. The method comprises applying the glue onto the moving web while the moving web moves along a direction and feeding the substance behind the outlet opening relative to the direction.

The substance may comprise at least one of a substance adapted to liquefy the glue, a low-viscosity fluid, water, and water vapor. The method may further comprise liquefying the glue after the applying. The method may further comprise liquefying the glue after the glue is applied to the moving web and the substance may comprise at least one of a substance adapted to liquefy the glue, a low-viscosity fluid, water, and water vapor. The feeding may comprise continuously feeding the substance behind the outlet opening relative to the direction. The feeding may comprise intermittently feeding the substance behind the outlet opening relative to the direction. The feeding may comprise cyclically feeding the substance behind the outlet opening relative to the direction.

The method may further comprise at least one of regulating the feeding and controlling the feeding. The method may further comprise at least one of regulating the feeding on a timely basis and controlling the feeding on a timely basis. The method may further comprise at least one of regulating the feeding on a quantity basis and controlling the feeding on a quantity basis. The method may further comprise controlling an amount of the substance which is applied to the moving web. The method may further comprise regulating an amount of the substance which is applied to the moving web via a measuring unit. The method may further comprise conveying, after the feeding, the moving web away from the device that delivers a substance to a region of the outlet opening.

The invention also provides for a system for applying glue to a moving web, wherein the system comprises a glue nozzle comprising an outlet opening arranged adjacent to the moving web. The glue nozzle applies the glue to the moving web while the moving web moves along a direction. A feeding device delivers a substance to the moving web in a region of the outlet opening. A system feeds the substance to the device delivers the substance. The substance comprises at least one of a substance adapted to liquefy the glue, a low-viscosity fluid, water, and water vapor.

The invention also provides for a method of applying glue to a moving web utilizing the system described above. The method comprises applying the glue onto the moving web while the moving web moves along a direction, feeding the substance behind the outlet opening relative to the direction, and regulating an amount of the substance which is applied to the moving web in the region of the outlet opening.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The system described with reference to FIGS. 1 and 2 serve preferably for applying glue to cigarette paper. However, other purposes in which glue is typically applied to a moving object, e.g. to folding box blanks, are also possible.

Figure 1:
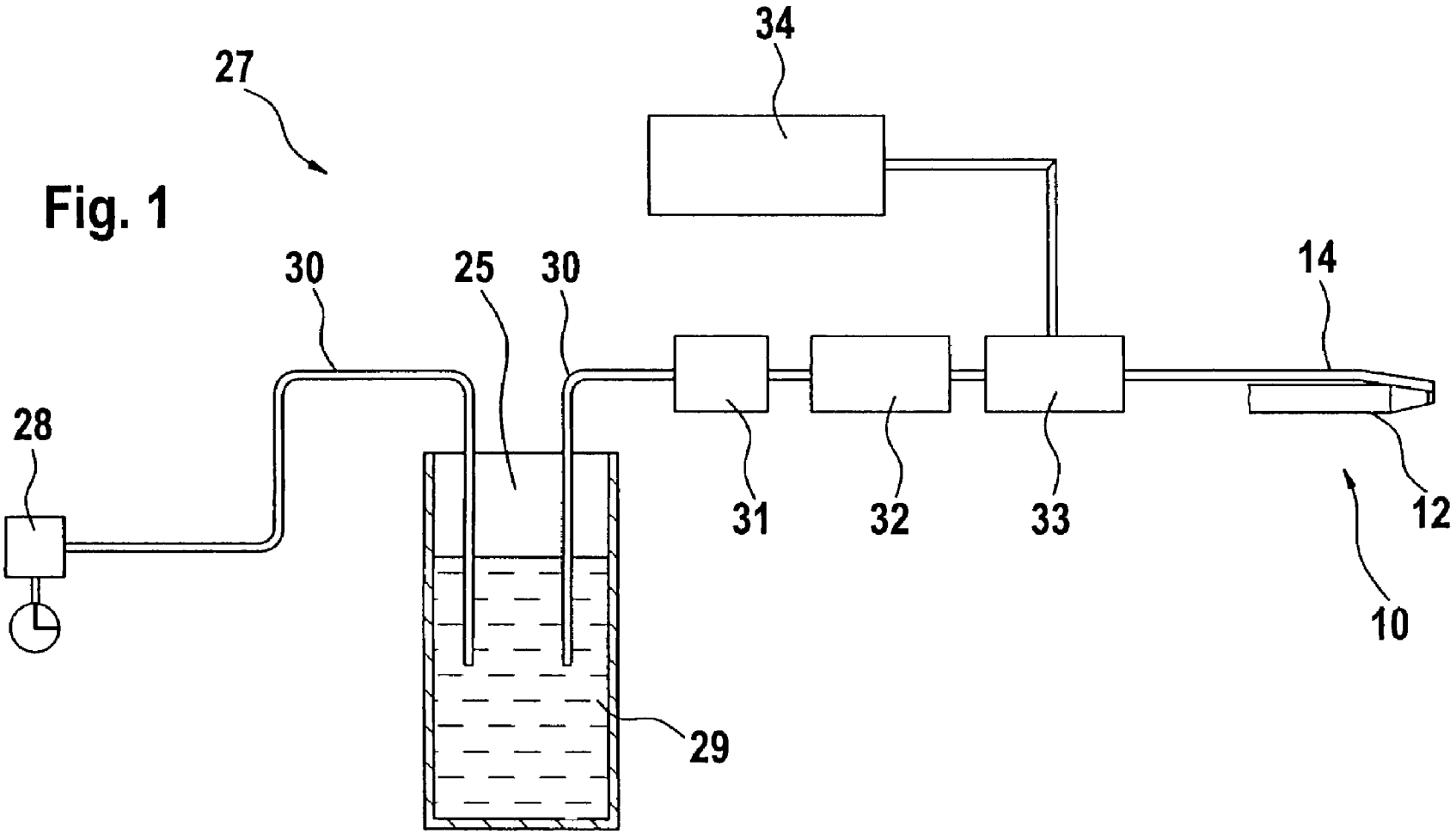
FIG. 1 shows a schematic view of a device (shown only partially) for applying glue with an associated measuring unit.
Figure 2:
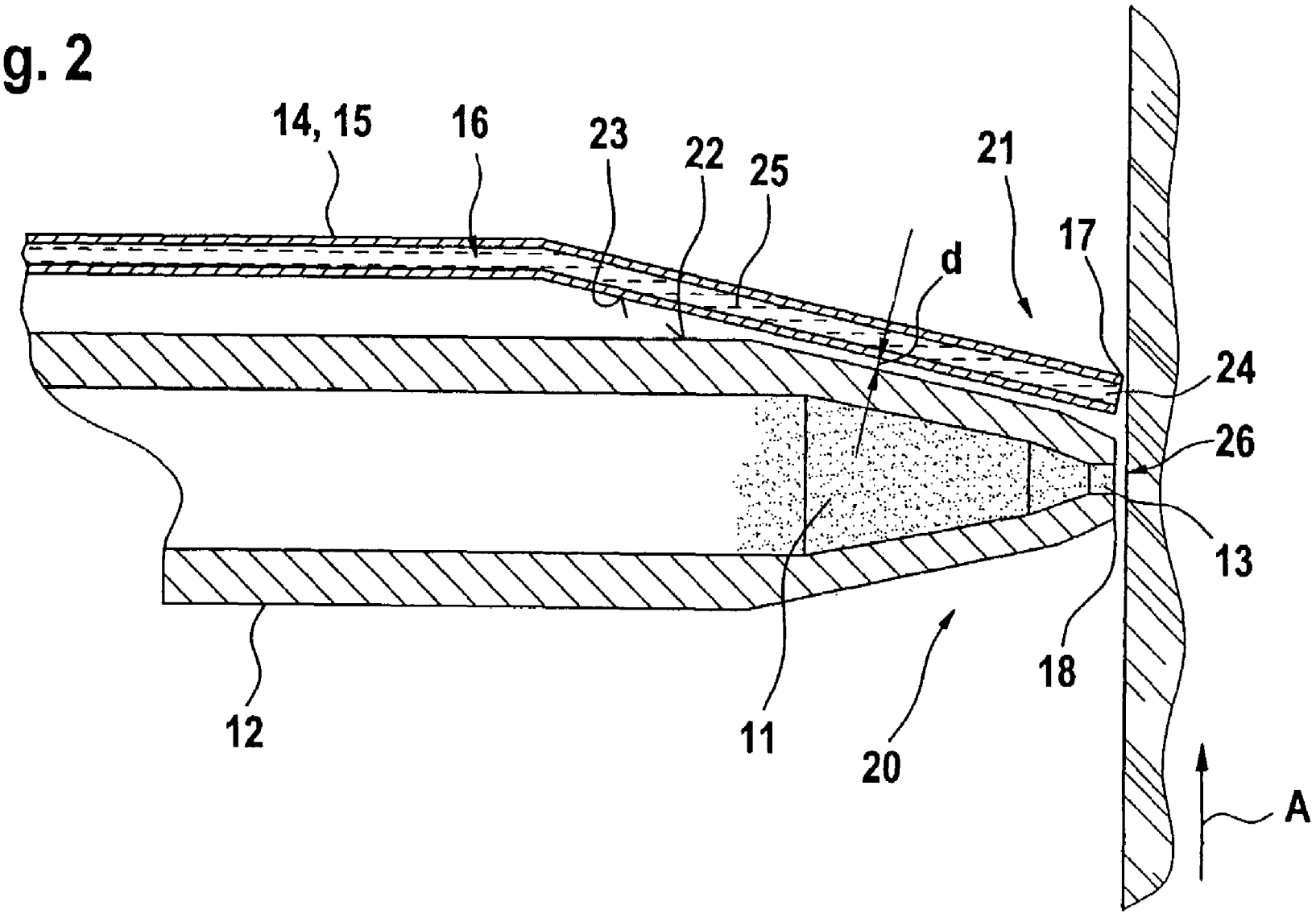
FIG. 2 shows an enlarged section view of the contact glue nozzle of FIG. 1.

The system shown in FIGS. 1 and 2 include a known device 10 for applying glue 11. Accordingly, essential components of the glue device 10 are not shown explicitly. The device 10 essentially includes a contact glue nozzle 12 which is connected to a reservoir (not shown) filled with glue 11. The glue 11 is delivered by conveying arrangement (also not shown) from the reservoir to the contact glue nozzle 12 and carried out of an outlet opening 13 in the region of the outlet opening.

In the region of the contact glue nozzle 12, or, to be more precise, in the region of the outlet opening 13, there is arranged a separate delivery device 14. The device 14 is positioned externally to the glue nozzle 12. In the embodiment shown, the delivery device 14 is constructed as a capillary 15. This capillary 15 has the form of a tube of very small diameter. Preferably, the diameter of the capillary 15, or of a channel 16 within the capillary 15, is no greater than approximately 2 mm. Of course, the size can also be configured relative to a number of considerations such as, e.g., the amount of adhesive or glue, the speed of the moving web, the glue density and/or consistency, etc, In the embodiment shown, the capillary 15 is constructed and/or formed separately from the contact glue nozzle 12 (i.e., as a separate element), and is mounted on and/or near the contact glue nozzle 12 in such a way that its free end 17 is approximately generally level with the free end 18 of the contact glue nozzle 12. The free end 17 can also preferably be slightly set back from the free end 18 relative to the cigarette paper 19 to be coated with glue.

According to one non-limiting preferred embodiment, the distance between the cigarette paper 19 and the free end 17 is at least approximately 0.3 mm. The capillary 15 is also arranged a short distance "d" from the contact glue nozzle 12. The distance "d" can be appropriately about 0.4 mm. The invention also contemplates other non-limiting embodiments wherein the distance "d" can have greater or lesser values, and may even be e.g., zero, i.e., the capillary 15 may abut closely against the contact glue nozzle 12. In a further non-limiting embodiment (not shown), the delivery device 14 can be constructed in one-piece with the contact glue nozzle 12, so that the device 14 and nozzle 12 for an integral assembly.

The tip 20 of the contact glue nozzle 12 tapers slightly conically towards the free end 18. The inclination or the angle of the tip 21 of the capillary 15 is adapted to the angle of the tip 20, such that the outer walls 22 or 23 of the contact glue nozzle 12 or of the capillary 15, in the region of the tips 20, 21 run essentially parallel to each other. This basically ensures that the substance 25 conveyed out of the capillary 15 can be delivered behind the contact glue nozzle 12 in the direction of transport of the moving, strip-like web, namely the cigarette paper 19. The channel 16 of the capillary 15 extends parallel to the outer wall 23. But the arrangement of the channel 16, or the angle at which the channel 16 leaves the tip 21, is as variable as the arrangement of the tips 20, 21 relative to each other.

A preferred non-limiting arrangement is one in which a substance 25, which is appropriately water, and which is conveyed out of the capillary 15 and exits in the region of an outlet opening 24 of the capillary 15, is conducted directly behind a contact region 26 formed between the contact glue nozzle 12 or the tip 20 and the cigarette paper 19. In this way, the substance 25 is delivered to the glue 11 to liquefy it. The closer the substance 25 can be brought to the outlet opening 13 or the contact region 26, the smaller is the tendency to form glue runs.

Spot delivery of the substance 25 exactly to the region in which potential excess glue can accumulate prevents the formation of glue runs without otherwise impairing the gluing process. Apart from water, other low-viscosity liquids (and even gaseous substances) can be used for liquefaction/thinning of the glue.

The delivery device 14 or the capillary 15 may also form part of a measuring system/unit 27. The fine measuring unit 27 can essentially include a pressure regulator 28, a storage device 29 for holding the substance 25, a pipe system (which can preferably be a rigid pipe system) 30 for connecting the individual components of the measuring unit 27, a fine filter 31, a fine measuring valve 32, a directional control valve 33 of neutral volume, and a control unit 34. The measuring unit 27 may, however, also have other elements, e.g. additional pressure reducers (not shown), throttles or the like. The whole measuring unit/system 27 including the delivery device 14 may be constructed in modular fashion as an assembly. In this way, conversion of cigarette-making machines which are already in use can be particularly easily accomplished.

The pressure reducer 28 functions to reduce the pressure—usually a pressure of about 5 bars prevails in the machine—to a working pressure of about 0.5 bar. To throttle the pressure to the working pressure, however, additional safety elements, e.g. a further pressure reducer, can also be utilized. In addition, an additional ⅔-way valve (not shown) for switching the compressed air can be arranged behind the pressure reducer 28 and in front of the storage device 29. Due to this air release function, the storage device 29 can be completely pressureless after shutting off the valve. The storage device 29 preferably has a volume of approximately 500 ml, and is under the low initial pressure of about 0.5 bar. This allows the volumetric stream to be independent of the filling height of the storage device 29.

A fine filter 31 is arranged between the storage device 29 and a fine measuring valve 32. The filter 31 protects firstly the fine measuring valve 32 and secondly the directional control valve 33 from becoming soiled and/or clogged. The second valve 33 can preferably be replaced by a solenoid valve. The fine measuring valve 32 serves to adjust the quantity of water. The directional control valve 33 or solenoid valve arranged between the valve 32 and the contact glue nozzle 12 or the delivery device 14 serves to open and close the delivery device 14, i.e., serves to open or close the flow through the deliver device 14. Between the fine measuring valve 32 and the directional control valve 33 or solenoid valve can be arranged an additional throttle (not shown). This additional throttle can provide a desired flow resistance and can preferably have an inside diameter of about 0.6 mm. The solenoid valve 33 is connected to the control unit 34, and arranged as close as possible to the contact glue nozzle 12 or delivery device 14.

The application of glue to moving webs is described below by the example of the strip-like cigarette paper 19 as shown in FIG. 2. The cigarette paper 19 is conveyed continuously at high speed, e.g. up to 750 m/min for continuous cigarette-making machines and past the contact glue nozzle 12. The movement of the web 19 is shown in a direction indicated by an arrow A. According to one non-limiting embodiment, the contact glue nozzle 12 with the tip 20 is always in contact with the cigarette paper 19. The glue 11 is continuously applied to the cigarette paper 19 by being conveyed or fed out of the outlet opening 13. The major proportion of the glue 11 wets the cigarette paper 19 in the regions provided. A proportion of the glue 11 is, however, conveyed behind the contact glue nozzle 12 in the direction of transport of the cigarette paper 19. This occurs particularly by transport of the cigarette paper 19, and accumulates there.

Precisely to this region, that is, immediately behind the contact glue nozzle 12, an additional substance 25, preferably water, is applied and/or fed onto the moving web which liquefies the accumulating glue 11. Delivery and/or feeding of the water can preferably be in a cyclic manner. Due to transport of the cigarette paper 19, the liquefied glue 11 is carried away out of the contact region 26 and received by the cigarette paper 19. In this way, recirculation of excess glue to the actual glue application process is obtained. No waste materials are therefore produced. As water is generally a constituent of the glue 11 anyway, it is particularly suitable for liquefaction. However, other substances, e.g. low-viscosity media or water vapor, can be also be used.

By way of the measuring unit/system 27, the quantity of water and the moment of delivery, inter alia, can be adjusted. Cyclic delivery of the water is preferred. However, continuous delivery may be desired too. Using the capillary 15, a quantity of water of preferably about 8-10 g/h can be added to the glue 11. If it is measured out cyclically, at least two adjustments are generally necessary. The opening time and the interval time may also be adapted to the process. The opening time affects the quantity of water, and if necessary, may be adapted to the size of the glue runs. The interval time is the time between two valve openings. It must always be shorter than the time between the formation of two glue runs. If the water is measured out cyclically, the directional control valve 33 or the solenoid valve can switch a volumetric stream on and off at preset intervals of time. Utilizing the control unit 34, both the duration of the "solenoid valve open" state and the duration of the "pause until next opening of valve" state can be adjusted. Utilizing a cyclic measuring out process, a water drop waiting for a glue run at the outlet opening 24 of the capillary 15 can be obtained selectively.

In continuous measuring out process, the solenoid valve serves exclusively an opening and closing function. In the continuous measuring out process, when the solenoid valve is open, it must be ensured by way of the fine measuring valve 32 that a continuous but very small volumetric stream is set. This ensures that the consistency of the glue 11 in not significantly altered. In addition to an automatic measuring out process, the invention contemplates that the water can also be measured out manually.

The application of glue to other moving webs, e.g. folding box blanks, can take place in an essentially similar manner. However, in this case it may be appropriate to move the blanks intermittently past the contact glue nozzle 12. This should also occur with a short distance between blank and contact glue nozzle 12.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed:

1. A method of applying glue to a moving web utilizing a system that includes a glue nozzle coupled to a glue reservoir, the glue nozzle comprising a tip having an outlet opening arranged to apply glue to the moving web, and a device that delivers a substance to a region of the outlet opening, wherein the device is a tube whose tip is arranged adjacent the tip of the glue nozzle, the method comprising:

applying the glue onto the moving web while the moving web moves along a direction;

feeding the substance behind the outlet opening relative to the direction; and at least one of:

controlling an amount of the substance which is applied to the moving web; and regulating an amount of the substance which is applied to the moving web via a measuring unit; and liquefying the glue after the applying.

2. A method of applying glue to a moving web utilizing a system that includes a glue nozzle coupled to a glue reservoir, the glue nozzle comprising a tip having an outlet opening arranged to apply glue to the moving web, and a device that delivers a substance to a region of the outlet opening, wherein the device is a tube whose tip is arranged adjacent the tip of the glue nozzle, the method comprising:

applying the glue onto the moving web while the moving web moves along a direction;

feeding the substance behind the outlet opening relative to the direction;

at least one of:

controlling an amount of the substance which is applied to the moving web; and regulating an amount of the substance which is applied to the moving web via a measuring unit; and liquefying the glue after the glue is applied to the moving web, wherein the substance comprises at least one of a substance adapted to liquefy the glue, a low-viscosity fluid, water, and water vapor.

3. The method of claim 2, wherein an internal passage of the tube is smaller than an internal passage of the glue nozzle.

* * * * *